United States Patent [19]

Burger et al.

[11] 3,963,321

[45] June 15, 1976

[54] CONNECTOR ARRANGEMENT FOR COAXIAL CABLES

[75] Inventors: Walter Burger, Bechen; Hans Leo Ditscheid, Refrath, both of Germany

[73] Assignee: Felten & Guilleaume Kabelwerke AG, Cologne, Germany

[22] Filed: Aug. 21, 1974

[21] Appl. No.: 499,427

[30] Foreign Application Priority Data

Aug. 25, 1973 Germany ..... 2343030

[52] U.S. Cl. ..... 339/177 E

[51] Int. Cl.[2] ..... H01R 17/04

[58] Field of Search ..... 339/177 R, 177 E; 174/75 C, 88 C, 89

[56] References Cited

UNITED STATES PATENTS

| | | | |
|---|---|---|---|
| 2,258,737 | 10/1941 | Browne | 174/75 |
| 2,460,304 | 2/1949 | McGee et al. | 174/88 C |
| 2,673,233 | 3/1954 | Salisbury | 174/88 C |
| 2,839,595 | 6/1958 | Felts et al. | 174/89 |
| 3,678,446 | 7/1972 | Siebelist | 339/177 E |
| 3,829,800 | 8/1974 | Spinner | 174/75 C |

FOREIGN PATENTS OR APPLICATIONS

| | | | |
|---|---|---|---|
| 1,393,559 | 2/1965 | France | 339/177 R |
| 621,459 | 4/1949 | United Kingdom | 339/177 R |
| 679,410 | 9/1952 | United Kingdom | 339/177 R |
| 904,673 | 8/1962 | United Kingdom | 174/89 |

*Primary Examiner*—Roy Lake
*Assistant Examiner*—Neil Abrams
*Attorney, Agent, or Firm*—Michael J. Striker

[57] ABSTRACT

The connector arrangement is moisture-proof and radiation-impervious. It includes a connector sleeve having a conical cavity which receives and secures that portion of the coaxial cable from which the outer protective sheath has been stripped. It furthermore includes a collar which tightly surrounds a section of the protective sheath of the cable. The connector sleeve has a shoulder setting off the collar from the conical cavity, and also has an outwardly projecting flange. An inset has an external thread at one end for connection to another component and is provided with an internal bore having a diameter equal to the outer diameter of the cable insulation or spacers. The inset furthermore has another external thread at the end thereof facing the connector sleeve. A connector nut engages the outwardly projecting flange and the external thread of the inset and, when tightened, causes the inset to be pulled into the connector sleeve.

10 Claims, 8 Drawing Figures

CONNECTOR ARRANGEMENT FOR COAXIAL CABLES

BACKGROUND OF THE INVENTION

The invention relates to the provision of a releasable, moisture-proof and radiation-impervious connector arrangement for coaxial cables, both of the type provided with solid insulation and of the air-spaced type.

Cable-television networks are so extensive, are comprised of so many different branches and are so repeatedly interrupted by subscriber hook-ups that the technology of connecting cables to amplifiers, distributors and branch connectors has become characterized by increasingly stringent demands regarding the ease with which the necessary connections can be made and the quality of the connections.

Experience has shown that the connector arrangements used heretofore require the use of a considerable number of expensive discrete components, if the connector arrangements are to be made moisture-proof and yet releasable, immune to the effects of high-frequency interference, capable of providing a lasting electrical connection, and correctly dimensioned with respect to characteristic impedance.

SUMMARY OF THE INVENTION

It is accordingly an object of the invention to provide a connector arrangement of the aforedescribed type capable of engaging the end of a coaxial cable in a secure and form-stable manner, even when subjected to repeated mechanical stresses, while providing a permanent electrical and mechanical connection.

Related objects are to make the connector arrangement moisture-proof, radiation-impervious, designed in a manner which avoids the development of interference due to reflection, and which is furthermore easily assembled and inexpensive.

These objects, and others which will become more understandable from the description, below, of exemplary embodiments, can be met, according to one advantageous concept of the invention, by providing a connector arrangement which can be connected to the end of a coaxial cable and which is comprised of essentially three discrete components:

a. a connector sleeve provided with an internal conical cavity which receives the outer conductor of a portion of a coaxial cable end from which the protected sheath has been removed, furthermore provided with a collar portion which can be fixedly secured to a portion of a coaxial cable from which the protective sheath has not been removed, furthermore provided with an interior shoulder setting the collar portion of the connector sleeve off from the portion provided with the internal conical cavity, and furthermore provided with an outwardly projecting annular ridge portion at that end of the connector sleeve which is provided with the conical cavity;

b. an inset provided with an externally screwthreaded portion, furthermore provided with a central bore the diameter of which is equal to the diameter of the dielectric insulation of the cable, further provided with a conical portion at that end of the inset which faces towards the internal conical cavity of the connector sleeve, and furthermore provided at its other end with an external screwthread; and c. a connecter nut which tightly connects together the connector sleeve and the inset.

The portion of the cable from which the protective outer sheath has not been removed is tightly received within and securely supported and reinforced by the collar portion of the connector sleeve. The portion of the cable end from which the protective sheath has been removed to expose the outer conductor is inserted into the connector sleeve until the end face of the protective sheath abuts against the shoulder provided in the interior of the connector sleeve. The position of this shoulder in the connector sleeve additionally serves to determine what length of the portion of the cable end from which the protective sheath has not been removed is to be supported and reinforced by being accommodated within the collar portion of the connector sleeve.

The exposed end portion of the outer cable conductor is tightly clamp between the conical portions of the connector sleeve and of the inset and is thereby caused to establish a reliable and permanent electrical connection with the connector. The metal seal which is thusly established additionally would serve to provide the protection against the effects of ever-present moisture which is necessary for catv cables. This metal seal furthermore guarantees the highest degree of radiation inperviousness—a feature of great importance in those frequency ranges in which other radio communications equipment could be interfered with as a result of radiation emitted from a faultily constructed connector arrangement.

A reliable connection is assured by provision of the connector nut, because the conical portion of the inset slides along the exposed cable insulation as the connector nut is tightened, until the leading edge of this conical portion slides under the end of the exposed portion of the outer conductor, lifting the thusly engaged portion of the outer conductor away from the underlying insulation and causing this portion of the outer conductor to widen and be tightly wedged between the conical portion of the inset and the internal conical cavity in the connector sleeve. The threaded extension of the inset serves in conjunction with a correspondingly threaded socket unit to connect the cable for example to the housing of a subscriber apparatus or, together with a known coupling element, to connect the cable to a second coaxial cable, the end of such second cable also being provided with a connector arrangement according to the invention, if desired.

According to a particularly advantageous concept of the invention, the collar portion of the connector sleeve is provided with an internal left-handed screwthread of very large pitch, so that the collar portion of the connector sleeve can be fixedly secured to the portion of the cable end from which the outer sheath has not been removed, simply by screwing the collar portion onto such portion of the cable end. This expedient furthermore has the advantage that the longitudinal position of the cable is reliably established and the possibility of longitudinal shifting is precluded. The outer conductor remains form-stable, so that reflections and changes of the characteristic impedance of the cable are avoided.

According to another advantageous concept of the invention, the internally screwthreaded collar portion of the connector sleeve is axially slit and is easily deformed in a manner causing the collar portion to assume a conical configuration. If the breadth of this slit is properly selected, then, when the connector nut is screwed onto the inset, the pressure of the collar portion upon the outer protective sheath of the cable can be adjusted as desired, and additionally the cable can be anchored in the connector sleeve in a manner which substantially precludes longitudinal shifting of the cable within the connector sleeve.

It can be advantageous to secure the connector sleeve not directly to the outer protective sheath of the cable, but rather to a clamping sleeve which surrounds the cable sheath, with the corresponding ends of the clamping sleeve and connector sleeve being matingly screwthreaded and connectable together in this way, and with the other end of the clamping sleeve being properly positioned by abutting against an inwardly projecting annular shoulder located inside the connector sleeve. To establish the screwthreaded connection between the clamping sleeve and the connector sleeve, it is sufficient to provide relatively short mating internal and external screwthreads on the two components. In the case of thin, synthetic plastic protective sheaths of insufficient longitudinal stiffness, the securing of the connector sleeve is accomplished by utilizing the friction between the protective sheath of the cable and the outer cable conductor. Moreover, the assembly of the connector arrangement is not made more complicated when the clamping sleeve is provided, because the end position of the clamping sleeve and of the protective sheath, and accordingly the length of the latter which is to be accommodated within the connector sleeve, are determined by the abutment of the clamping sleeve and the protective sheath against the shoulder of the connector sleeve, thereby preventing shifting during and after the assembly.

According to a further advantageous concept of the invention, the clamping sleeve referred to above is provided with a plurality of inwardly projecting annular ridges. In this case, the connector nut can be so configurated as to tightly surround the clamping sleeve and the connector sleeve and the cable, with the inwardly projecting flange-like portion of the connector nut embracing and engaging the free ends of the clamping sleeve and of the collar portion of the connector sleeve. In this way, it becomes possible to form the inwardly projecting annular ridges in the clamping sleeve during the assembly of the connector arrangement after the clamping sleeve has been slid over the portion of the cable end from which the protective sheath has not been removed.

According to another advantageous concept of the invention, the coaxial cable has a protective outer sheath made of lead, and the connector sleeve is fixedly secured by soft solder to that portion of the cable end from which the sheath has not been removed.

According to a particularly advantageous concept of the invention, the aforedescribed conical end portion of the inset is provided with a sliding bead portion. This sliding bead portion prevents a scraping off of insulator material by the conical end portion. Such scraped-off insulating material could otherwise enter between the conical surface of the inset and the widened end portion of the outer cable conductor, detrimentally affecting the seal and the electrical connection there.

According to a further concept of the invention, the wall of the internal conical cavity in the connector sleeve is provided with one or more inwardly projecting annular beads, and the cone angle of the concial end portion of the inset, measured relative to the symmetry axis of the coaxial cable, and the cone angle of the conical cavity in the connector sleeve are different, the latter cone angle being smaller than the former cone angle. This configuration results in the establishment of a very advantageous moisture-proof and electrically conductive press fit for the metal seal.

When aluminum is used for the outer conductor, the durability of the contact reliability can be improved if a permanently elastic spring is arranged intermediate the abutting surfaces of the connector nut and of the connector sleeve.

According to a further concept of the invention, when the inset is made of copper the cone angle of the conical portion of the inset is preferably 7°; when the inset is made of aluminum the cone angle of the conical portion of the inset is preferably 15°. In the case of copper if the cone angle in question is 10° or more there is a tendency to form notches resulting in the breaking off of material, whereas the angles of 6° or less a self-locking action occurs.

To facilitate assembly of the connector arrangement the connector sleeve has a cylindrical portion between the conical cavity thereof and the internal shoulder thereof. The diameter of this cylindrical portion is slightly greater than the diameter of the outer cable conductor. This cylindrical portion serves a guidance function when the connector sleeve is pushed over and onto the portion of the cable end at which the outer conductor is exposed, so as to avoid improper oblique positioning of the connector sleeve on the cable during assembly.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

The connector arrangements shown in FIGS. 1–6 are each comprised of three essential components: a connector sleeve 1, an inset 11 and a connector nut 18. Only the surface of the bore of the inset 11 need be of a material suited for high-frequency transmission. The connector sleeve 1 and the connector nut 18 can be made of synthetic plastic. If aluminum is employed for these three components, then it is recommended to oxidize the exposed surfaces.

Figure 1:
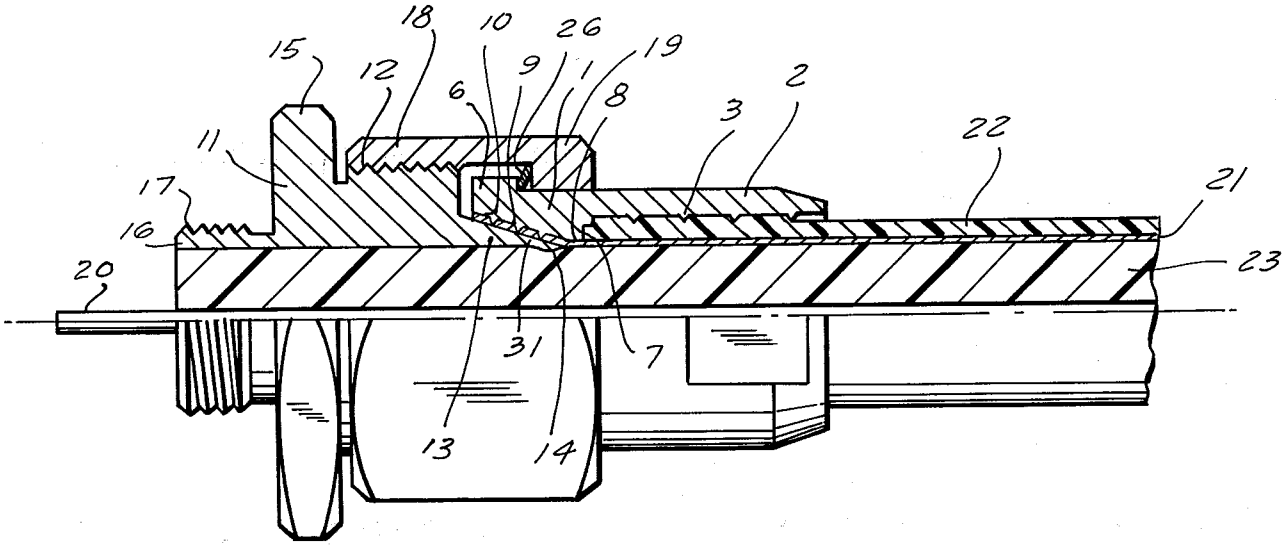
FIG. 1 is a side view of an end of a coaxial cable received in a first connector arrangement according to the invention, the upper half of the view being in longitudinal section.

In the embodiment shown in FIG. 1, the connector sleeve 1 is comprised of a collar portion 2 provided with a continuous internal screwthread 3. The connector sleeve 1, when screwed onto the end of the protective sheath 22 of the coaxial cable, supports and reinforces the coaxial cable and simultaneously assures the proper positioning of the coaxial cable against the action of mechanical stress, for example tensile stress in the longitudinal direction of the cable. The connector sleeve 1 is provided with a shoulder 7 against which abuts the end of the protective sheath 22, thereby serving to limit and properly position the protective sheath 22 and accordingly the cable end itself within the connector arrangement. To this end, before the connector arrangement is actually connected to a cable end, the protective sheath 22, which can for example be made of synthetic plastic or of lead, must be removed from the end portion of the coaxial cable, so as to expose a predetermined length of the outer conductor 21. The outer conductor 21 should be exposed for a length determined by the conical cavity 9 in the interior of the connector sleeve 1. The end portion of the outer conductor 21 is widened to be accommodated within and tightly secured within the conical cavity 9. This widening of the end portion of the outer conductor 21 is achieved with the help of the conical portion 13 of the inset 11. The internal bore of the inset 11 has an inner diameter equal substantially exactly to the outer diameter of the dielectric insulating material 23 which is exposed when both the outer protective sheath 22 and the outer conductor 21 are stripped off. The left end portion of the connector nut 18 is internally screw-threaded, and can be screwed onto the external screwthread 12 of the inset 11. When the connector nut 18 is thusly screwed onto the inset 11, the inset 11 is drawn into the connector nut 18, in direction towards the connector sleeve 1. As this occurs, the conical end portion 13 of the inset 11 slides in between the end portion of the outer conductor 21 and the adjoining portion of the insulation 23, thereby widening the end portion of the outer conductor 21 and firmly clamping or wedging the thusly widened end portion of the outer conductor 21 between the conical portion 13 and the wall of the conical cavity 9, so as to result in a moisture-proof and radiation-impervious metal seal 31.

This seal can be made still more secure by providing an inwardly projecting annular ridge 10 on the wall of the conical cavity 9 and by providing a sliding bead 14 at the end of the conical portion 13. Provision of the bead 14 assures that as the bead 14 advances rightwardly over the material of the insulation 23, insulating material which is rubbed off will not be able to undesirably enter into the aforedescribed metal seal 31. Additionally, the cone angle of the conical portion 13 is larger than the cone angle of the conical cavity 9, and this further improves the quality of the metal seal 31, although this improvement cannot per se be seen in the drawing.

When by means of the six-edged portion 15 the connector nut 18 is screwed onto the external thread 12 of the inset 11, causing the inset 11 to be pulled into the connector nut 18, the inwardly projecting flange-like portion 19 of the connector nut 18 comes into secure engagement with the annular end surface of the outwardly projecting abutment portion 6 of the connector sleeve 1. If aluminum is used for the connector components, then the contact reliability of the arrangement is improved by providing a permanently elastic spring member 26 between the connector nut 18 and the connector sleeve 1. The cylindrical region 8 between the shoulder 7 of the connector sleeve 1 and the conical cavity 9 in the interior of the connector sleeve 1 serves to make more reliable the guidance of the cable end into the connector sleeve as the connector sleeve 1 is slid over onto the portion of the cable end along which the protective casing 22 has been stripped off and the outer conductor 21 exposed.

The electric insulation 23 of the coaxial cable ends within the annular extension 16 of the inset 11. The annular extension 16 is provided with an external screwthread 17. The inner conductor 20 of the coaxial cable extends further leftwards for a distance dependent upon the kind of device to which the cable is to be connected.

Figures 2, 2A:
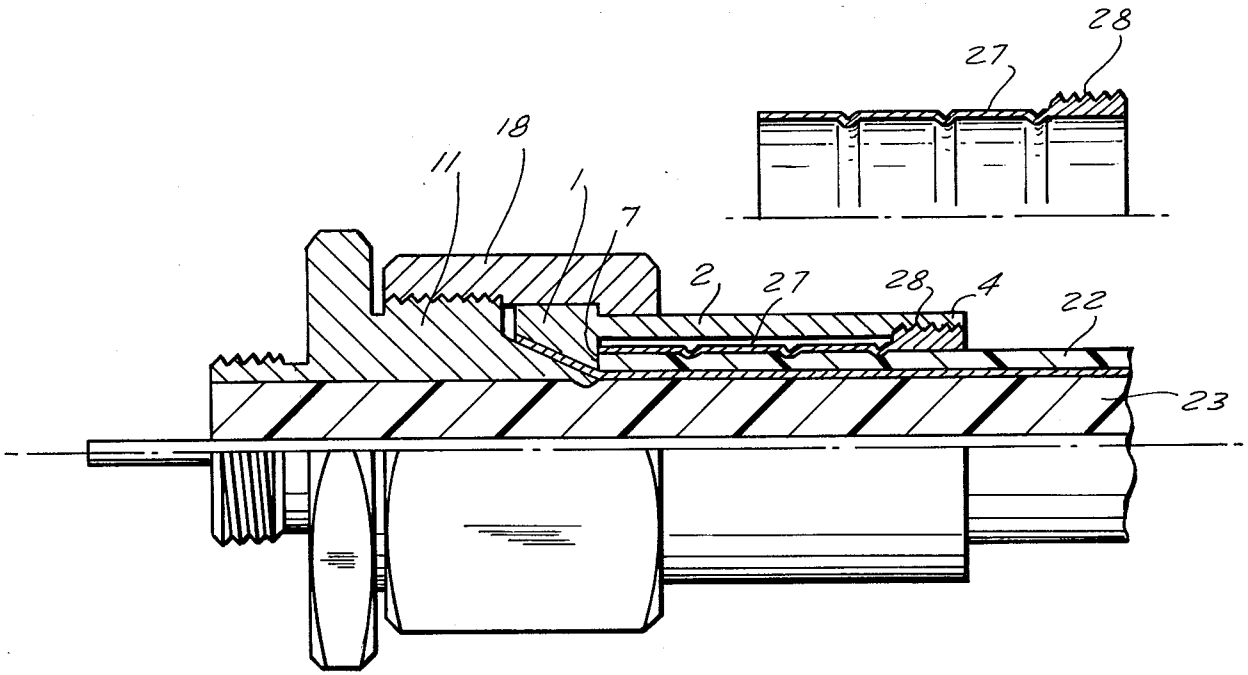
FIGS. 2–5 are views similar to FIG. 1 but depicting respective second, third, fourth and fifth connector arrangements according to the invention.

The connector arrangement of FIG. 2 differs from that of FIG. 1 by the provision of a further member, namely a clamping sleeve 27 (shown separately in FIG. 2*a*) located intermediate the collar portion 2 of the connector sleeve 1 and the protective sheath 22 of the coaxial cable. The use of the clamping sleeve 27, which provides considerable reinforcement, is particularly appropriate when the protective sheath 22 of the cable is thin or of a material exhibiting insufficient longitudinal stiffness.

The left-hand end portion of the clamping sleeve 27 abuts against the shoulder 7 of the connector sleeve 1, which contributes to the correct positioning of the clamping sleeve 27. Additionally, the right-hand end portion of the clamping sleeve 27 is provided with an external screwthread 28 which mates with a corresponding internal screwthread 4 provided at the right-hand end of the connector sleeve 1, in this embodiment. The connection together of the components 1 and 27 both by means of abutment at the left end of sleve 27 and by means of mating screwthreads at the right end of sleeve 27 ensures that the components 1 and 27 will not shift relative to each other.

Figures 3, 3A:
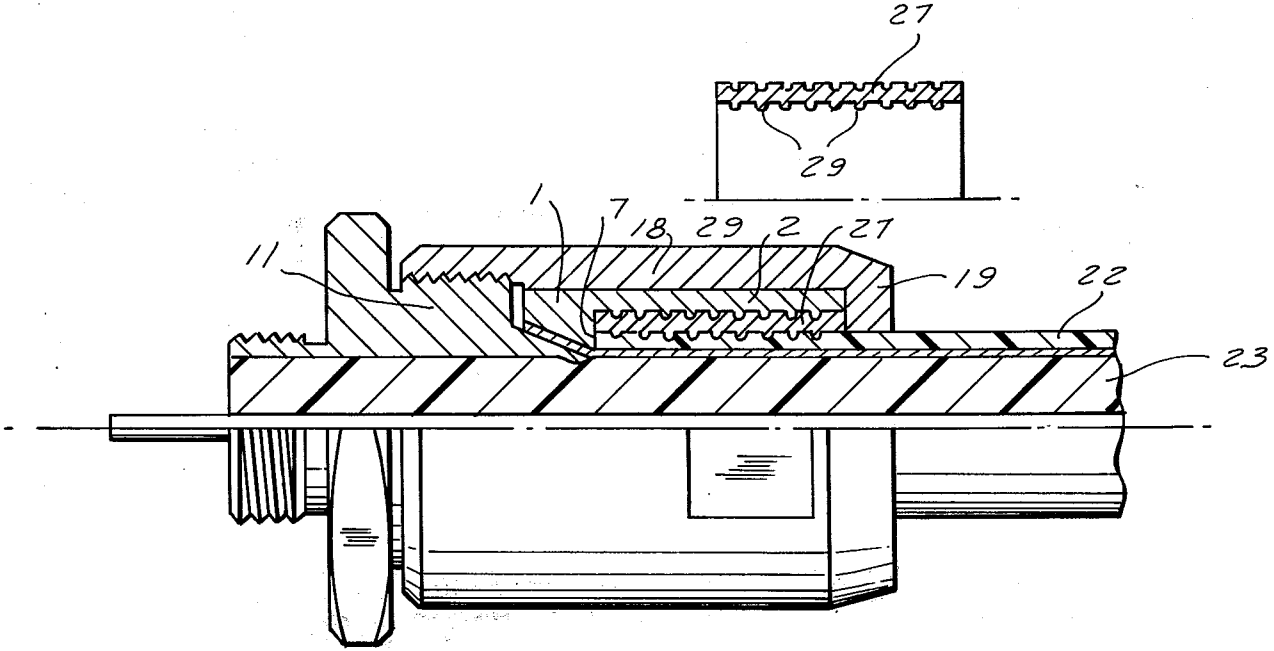

The embodiment of FIG. 3 is similar to that of FIG. 2, but makes use of a clamping sleeve 27 of a somewhat different configuration differently connected to the connector sleeve 1. In FIG. 3, the clamping sleeve 27 is provided with nine radially inwardly projecting ridges 29 which serve to hold the protective casing 22 of the coaxial cable with very great firmness. The clamping sleeve 27 is provided with these ridges only after it has been properly positioned around the end portion of the protective sheath 22. Since the inwardly projecting flange-like portion 19 of the connector nut 18 embraces the right-hand end portions of both the collar portion 2 of the connector sleeve 1 as well as the clamping ring 27, there is no need for the outwardly projecting abutment portion 6 employed in FIG. 1, and this portion is accordingly omitted in FIG. 3.

For the sake of clarity the clamping sleeve 27 of FIG. 3 is shown separately in FIG. 3*a*.

Figure 4:
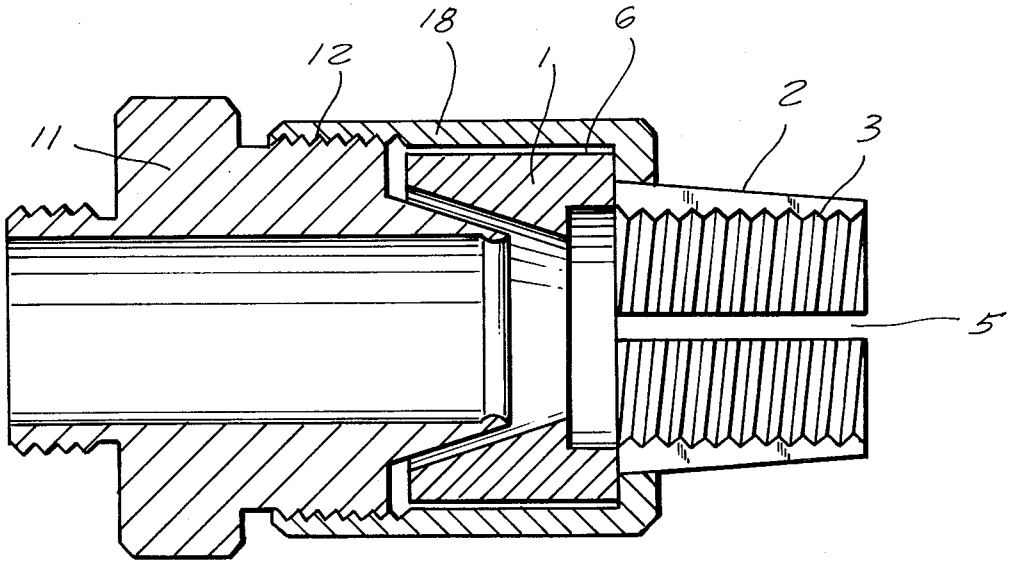

The embodiment of FIG. 4 differs from those of FIGS. 1–3 in the configuration of the collar portion 2 of the connector sleeve 1. In FIG. 4, the collar portion 2 is of conical configuration and is slotted. As the connector nut 18 is screwed onto the inset 11, the connector nut 18, the right end of which surrounds the collar portion 2, will travel in leftward direction along the length of collar portion 2, thereby compressing the collar portion 2 and causing the slit 5 to become smaller and smaller as the righthand end portion of connector nut 18 nears the abutment portion 6 of connector sleeve 1. As a result, the nonillustrated protective casing of the coaxial cable will become more and more tightly gripped by the internal thread 3 of the collar portion 2.

Figure 5:
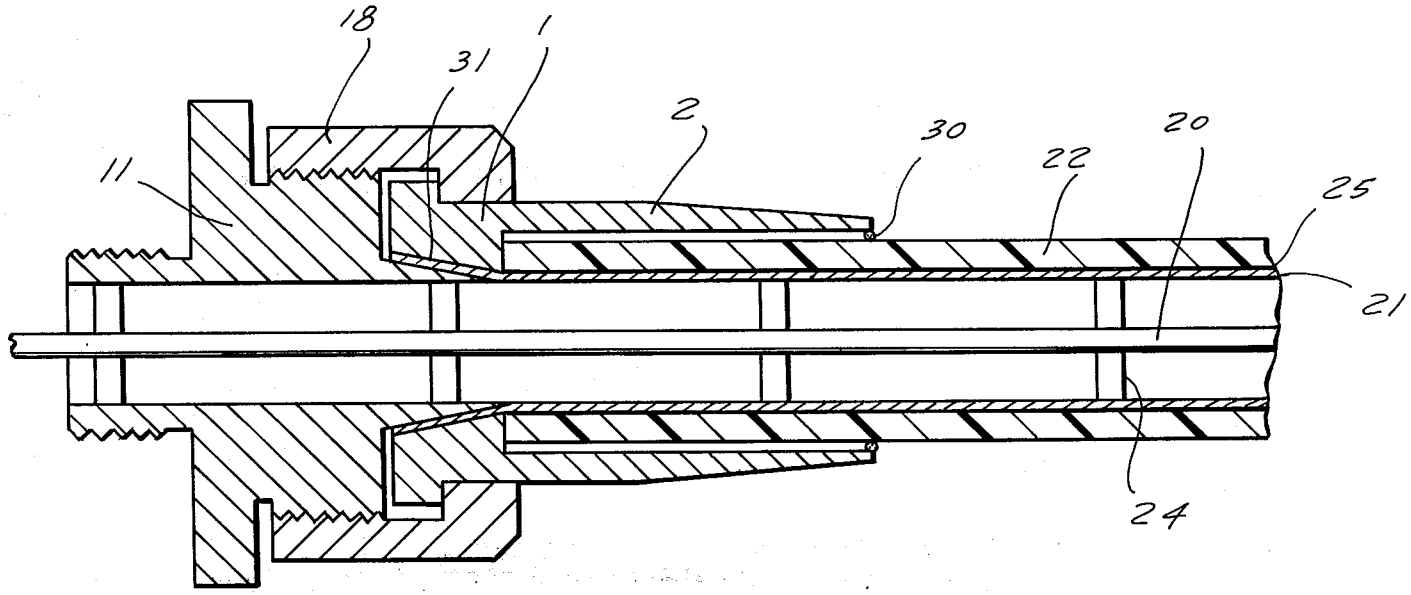

The embodiment of FIG. 5 differs from those of FIGS. 1–4 in the construction of the coaxial cable and the manner in which it is connected to the collar portion 2 of the connector sleeve 1. In FIG. 5, the connector arrangement is used with an air-spaced lead-covered coaxial cable provided with paper insulation 25 between the outer conductor 21 and the protective sheath 22 made of lead. Annular spacers 24 maintain the proper spacing between the coaxial components of the cable. The collar portion 2 of the connector sleeve 1 can be readily secured to the lead protective sheath 22 by means of soft solder 30, with the same mechanical stability being achieved as is achieved with the constructions of FIGS. 1–4. The metal seal 31 between the connector sleeve 1 and the inset 11 is formed by the outer conductor 21 itself, which usually consists of copper.

Figure 6:
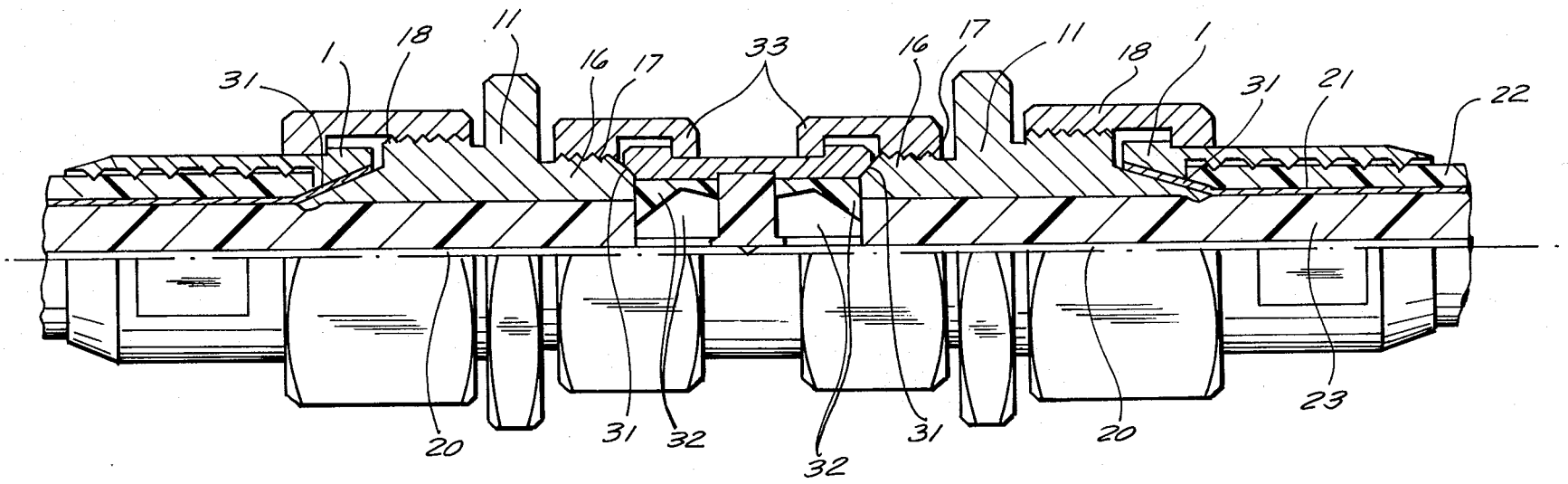
FIG. 6 is a view similar to FIGS. 1–5 but depicting two connector arrangements according to the invention, each connected to the end of a respective cable, with the two connector arrangements being joined together by a further coupling arrangement.

FIG. 6 depicts the junction of two axial cables, each having an end portion connected to a connector arrangement of the type shown in FIG. 1. The two connector arrangements are connected to each other by means of a per se known coupling arrangement 32, 33, comprised, for example, of the slotted inner-conductor clamping sleeve with the synthetic plastic clamping cones 32 and the outer-conductor screwthreaded connectors 33.

It will be understood that each of the elements described above, or two or more together, may also find a useful application in other types of constructions differing from the types described above.

While the invention has been illustrated and described as embodied in a connector for the ends of coaxial cables, it is not intended to be limited to the details shown, since various modifications and structural changes may be made without departing in any way from the spirit of the present invention.

Without further analysis, the foregoing will so fully reveal the gist of the present invention that others can, by applying current knowldge, readily adapt it for various applications without emitting features that, from the standpoint of prior art, fairly constitute essential characteristics of the generic or specific aspects of this invention.

We claim:

1. In a combination, a coaxial cable having a protective outer sheath, an outer conductor inwards of said outer sheath and an inner conductor inwards of said outer conductor, the coaxial cable having an end comprised of an endmost first portion along which said inner conductor is exposed, a second portion from which both said protective sheath and said outer conductor have been removed, a third portion from which said protective sheath has been removed, and a fourth portion from which said protective sheath has not been removed; a moisture-proof and radiation-impervious connector arrangement connected to said end of said coaxial cable and comprising a connector sleeve having one end surrounding and tightly holding said fourth portion of said cable and provided at its other end with an internal conical cavity surrounding said third portion of said cable, an additional one-piece connector unit including an axially extending portion surrounding said second portion of said cable and having a conically configurated end portion which is located slipped under said outer conductor along at least part of said third portion of said cable, said conically configurated end portion projecting into said conical cavity in said connector sleeve, and said outer conductor along at least said part of said third portion of said cable being outwardly deformed and widened and tightly wedged between the outer surface of said conically configured end portion and the wall of said internal conical cavity all around the circumference of the wedged portion of said outer conductor, said conically configurated end portion, said wall of said internal conical cavity and the wedged portion of said outer conductor together forming a circumferentially complete annular seal, and wherein the material of said additional connector unit at the portion thereof in contact with said wedged part of said outer conductor is electrically conductive so that all around said circumferentially complete annular seal there exists a circumferentially complete annular zone of electrical contact between the wedged portion of said outer conductor and said conically configurated end portion; and means connecting together said connector sleeve and said additional connector unit, wherein said connector sleeve is comprised of a collar portion which constitutes said one end of said connector sleeve and which surrounds and tightly holds said protective outer sheath and an internal shoulder separating the interior of said collar portion from said internal conical cavity, said collar portion being provided on the interior wall thereof with a large-pitch screwthread screwed into the material of said protective sheath of said fourth portion of said cable end, and wherein the end face of said protective sheath at the boundary of said fourth portion of said cable abuts against said shoulder to be thereby properly positioned within said connector sleeve, wherein said connector sleeve at the end thereof provided with said internal conical cavity is further provided with an annular outwardly projecting abutment portion, and wherein said means comprises a connector nut having one end provided with an inwardly projecting ridge-like portion which abuts against said outwardly projecting abutment portion and another end in screwthreaded engagement with said additional connector unit, said screwthreaded engagement being such that when said connector nut is tightened said inwardly projecting ridge-like portion presses against said outwardly projecting abutment portion thereby drawing said connector sleeve and said additional connector unit tightly together, wherein said additional connector unit is an inset which is partially received within said connector nut and partially received within said internal conical cavity, and wherein said cable along said second portion thereof has a predetermined outer diameter, and wherein said inset has an internal bore having a diameter substantially equal to said predetermined outer diameter so as to surround and firmly hold said second portion of said cable end, and wherein said inset at the end thereof facing away from said internal conical cavity is further comprised of an extension provided with an external screwthread for connecting said inset to another component.

2. The combination defined in claim 1, wherein said collar portion is slitted and of slightly conical configuration tapering in direction away from said abutment portion so that when said connector nut is tightened said inwardly projecting ridge-like portion of said connector nut advances along the conically configurated collar portion towards said abutment portion increasingly compressing said collar portion and thereby increasing the force with which said collar portion holds said fourth portion of said cable end.

3. The combination defined in claim 1, wherein said conically configurated end portion of said additional connector unit is provided with a slide ridge below the apex of the cone defined by said conically configurated end portion.

4. The combination defined in claim 1, wherein the interior wall surface of said connector sleeve defining said internal conical cavity is provided with a plurality of inwardly projecting annular ridges.

5. The combination defined in claim 1, wherein the cone angle of said internal conical cavity is smaller than the cone angle of the cone defined by said conically configurated end portion of said connector unit.

6. The combination defined in claim 1, wherein said outer conductor is made of copper, and wherein the cone angle of said conically configurated end portion of said inset is substantially 7°.

7. The combination defined in claim 1, wherein said outer conductor is made of aluminum, and wherein the cone angle of said conically configurated end portion of said inset is substantially 15°.

8. The combination defined in claim 1, wherein the internal surface of said connector sleeve intermediate said internal conical cavity and said internal shoulder is comprised of a cylindrical surface portion having a diameter slightly greater than the outer diameter of said outer conductor.

9. The combination defined in claim 1, wherein said connector sleeve is a one-piece member and wherein said connector nut is a one-piece member.

10. In a combination, a coaxial cable having a protective outer sheath, an outer conductor inwards of said outer sheath and an inner conductor inwards of said outer conductor, the coaxial cable having an end comprised of an endmost first portion along which said inner conductor is exposed, a second portion from which both said protective sheath and said outer conductor have been removed, a third portion from which said protective sheath has been removed, and a fourth portion from which said protective sheath has not been removed; a moisture-proof and radiation-impervious connector arrangement connected to said end of said coaxial cable and comprising a connector sleeve having one end surrounding and tightly holding said fourth portion of said cable and provided at its other end with an internal conical cavity surrounding said third portion of said cable, an additional one-piece connector unit including an axially extending portion surrounding said second portion of said cable and having a conically configurated end portion which is located slipped under said outer conductor along at least part of said third portion of said cable, said conically configurated end portion projecting into said conical cavity in said connector sleeve, and said outer conductor along at least said part of said third portion of said cable being outwardly deformed and widened and tightly wedged between the outer surface of said conically configurated end portion and the wall of said internal conical cavity all around the circumference of the wedged portion of said outer conductor, said conically configurated end portion, said wall of said internal conical cavity and the wedged portion of said outer conductor together forming a circumferentially complete annular seal, and wherein the material of said additional connector unit at the portion thereof in contact with said wedged part of said outer conductor is electrically conductive so that all around said circumferentially complete annular seal there exists a circumferentially complete annular zone of electrical contact between the wedged portion of said outer conductor and ssaid conically configurated end portion; and means connecting together said connector sleeve and said additional connector unit, wherein said connector sleeve is comprised of a collar portion which constitutes said one end of said connector sleeve and which surrounds and tightly holds said protective outer sheath and an internal shoulder separating the interior of said collar portion from said internal conical cavity, and wherein the end face of said protective sheath at the boundary of said fourth portion of said cable abuts against said shoulder to be thereby properly positioned within said connector sleeve, wherein said connector sleeve at the end thereof provided with said internal conical cavity is further provided with an annular outwardly projecting abutment portion, and wherein said means comprises a connector nut having one end provided with an inwardly projecting ridge-like portion which abuts against said outwardly projecting abutment portion and another end in screwthreaded engagement with said additional connector unit, said screwthreaded engagement being such that when said connector nut is tightened said inwardly projecting ridge-like portion presses against said outwardly projecting abutment portion thereby drawing said connector sleeve and said additional connector unit tightly together, wherein said additional connector unit is an inset which is partially received within said connector nut and partially received within said internal conical cavity, and wherein said cable along said second portion thereof has a predetermined outer diameter, and wherein said inset has an internal bore having a diameter substantially equal to said predetermined outer diameter so as to surround and firmly hold said second portion of said cable end, and wherein said inset at the end thereof facing away from said internal conical cavity is further comprised of an extension provided with an external screwthread forconnecting said inset to another component, wherein said connector arrangement further includes a clamping sleeve surrounding and clamping said fourth portion of said cable end, said clamping sleeve having one end which adjoins said end face of said protective sheath and together with the latter abuts against said shoulder, to thereby be properly positioned within said connector sleeve, and wherein said clamping sleeve is provided at its other end with an external screwthread mating with an internal screwthread provided on the adjoining interior wall of said collar portion, wherein said clamping sleeve is provided with a plurality of annular inwardly projecting radial ridges.

* * * * *